US006095532A

United States Patent [19]

Martin

[11] Patent Number: 6,095,532

[45] Date of Patent: Aug. 1, 2000

[54] FOLDING CREEPER

[75] Inventor: James E. Martin, Mooresburg, Tenn.

[73] Assignee: Holden Williams, Morristown, N.J.

[21] Appl. No.: 09/055,172

[22] Filed: Apr. 3, 1998

[51] Int. Cl.[7] ..... B25H 5/00

[52] U.S. Cl. ..... 280/32.6; 280/30; 280/651; 280/657

[58] Field of Search ..... 280/32.6, 32.5, 280/30, 638, 639, 640, 651, 87.01, 87.05, 657, 79.11, 79.2, 47.35

[56] References Cited

U.S. PATENT DOCUMENTS

| | | | |
|---|---|---|---|
| 1,072,052 | 9/1913 | Stoehr | 280/32.6 |
| 1,601,250 | 9/1926 | Hilderbrand | 280/30 |
| 2,595,784 | 5/1952 | Griffin, et al. . | |
| 2,611,417 | 9/1952 | Henry et al. . | |
| 2,861,279 | 11/1958 | Myers | 280/32.6 |
| 4,105,242 | 8/1978 | Terbeek | 280/30 |
| 4,125,269 | 11/1978 | Kiel | 280/30 |
| 4,325,323 | 4/1982 | Rioux | 118/504 |
| 4,505,495 | 3/1985 | Foss et al. | 280/651 |
| 4,531,752 | 7/1985 | Diener | 280/47.18 |
| 4,580,799 | 4/1986 | Quinonez | 280/32.6 |
| 4,717,169 | 1/1988 | Shaffer | 280/657 |
| 4,895,380 | 1/1990 | Brooks et al. . | |
| 5,451,068 | 9/1995 | Shockley . | |
| 5,577,744 | 11/1996 | Parks . | |
| 5,611,552 | 3/1997 | Miles . | |

FOREIGN PATENT DOCUMENTS

| | | | |
|---|---|---|---|
| 1051053 | 3/1979 | Canada | 280/32.6 |

*Primary Examiner*—J. J. Swann
*Assistant Examiner*—Michael Cuff
*Attorney, Agent, or Firm*—Pitts & Brittian, P.C.

[57] ABSTRACT

An improved folding creeper designed for being folded to define a rolling utility cart, a rolling stool having a storage receptacle under the seat, or to be folded for storage within a drawer of a conventional tool chest. The improved creeper includes a frame segmented into a first support frame hingeably attached to a second support frame, which is hingeably attached to a third support frame. First, second and third cushions are mounted to the respective support frames to provide comfort to the user. A head rest cushion is attached to the cushion mounted on the third support frame via a tether. Casters are secured under the first and second support frames for accomplishing mobility of the creeper in its various configurations. A pair of oppositely disposed first telescoping braces is provided for maintaining a selected relative orientation of the third support frame and the first and second support frames, collectively. A pair of oppositely disposed second telescoping braces is provided for maintaining a selected orientation of the second support frame with respect to the first support frame. The improved creeper may be manipulated to define several useful configurations. The third support frame is pivoted upwardly to elevate the head of the user when the improved creeper is configured to define a creeper. In another configuration, the improved creeper is manipulated to define a rolling stool having a compartment for carrying accessories, or a rolling utility cart. The improved creeper may be folded to a size which may be conveniently stored in a storage drawer of a conventional tool chest.

34 Claims, 7 Drawing Sheets

FOLDING CREEPER

TECHNICAL FIELD

This invention relates to the field of folding creepers. More specifically, the present invention relates to a wheeled folding creeper which may be unfolded to be used as a creeper, folded in one disposition to be used as a stool or utility cart, or folded in a second disposition for storage.

BACKGROUND ART

In the field of auto mechanics, it is well known that creepers are used to mobilize a mechanic while working under a vehicle. Creepers allow for the mechanic to move about freely while also allowing for minimal clearance under the vehicle.

Typical of the art are those devices disclosed in the following U.S. Patents:

| Pat. No. | Inventor(s) | Issue Date |
|---|---|---|
| 2,595,784 | J. W. Griffin, et al. | May 6, 1952 |
| 2,611,417 | A. L. Henry, et al. | Sept. 23, 1952 |
| 4,895,380 | B. Brooks, et al. | Jan. 23, 1990 |
| 5,451,068 | T. Shockley | Sept. 19, 1995 |
| 5,611,552 | J. J. Miles, et al. | Mar. 18, 1997 |
| 5,577,744 | J. E. Parks | Nov. 26, 1996 |

The '784 device disclosed by Griffin, et al., is a creeper which includes an upper torso support and a head rest. A plurality of support arms is provided for accomplishing pivotal displacement of the head rest above the torso support, each of which includes a lower end for engaging the support surface upon which the creeper is disposed. When the head rest is disposed above the torso support, and a load is applied to the head rest, the engagement of the lower ends of the support arms prevents movement of the creeper with respect to the support surface, thereby preventing the '784 device to be used as a utility cart. Nor may the '784 device be used as a stool for the mechanic which may be wheeled about while the mechanic is supported thereon. Further, the '784 device may not be folded for storage.

The '417 device disclosed by Henry, et al., includes a centrally-disposed bed and a pair of leg units, with one on either end of the bed. Each leg unit may be folded under the bed for compact storage, may be folded out to extend away from the bed, or may be disposed at an obtuse angle with respect to the bed in order to raise either or both ends of the bed above a support surface. Although the '417 device may be folded for compact storage, it may not be converted to a rolling utility cart or stool. Further, although the '417 device may be manipulated to define a stool, there is no provision for a storage shelf below the seat of the stool.

The '380 device disclosed by Brooks, et al., includes a bifurcated support surface which may be elevated and tilted. The two portions of the support surface are hinged together to define a continuous support surface. The adjustment mechanism is configured to allow independent movement of each portion of the support surface. However, the '380 device is not capable of being configured to define a rolling stool or utility cart. Although the support surface may be elevated to a height similar to a cart, there is no provision for tool storage under the support surface. Nor is the '380 device capable of being folded to a configuration suitable for storage.

Shockley ('068) discloses a creeper which is transformable into a rolling utility cart or stool. The '068 device includes a frame sectioned into three segments. A base recess is defined by one end section and receives a removable pad. In order to manipulate the creeper into a stool, the pad is removed and the creeper frame is collapsed in a "Z" configuration, with the head rest becoming the stool cushion. A plurality of retention elements is provided for maintaining the relative orientation of the three frame segments when a load is applied to the head rest/seat cushion. The base recess then serves as a tool receptacle for a mechanic. However, as indicated, in order to achieve this disposition of the creeper, the pad must be removed. Further, because of the configuration of the retention elements, the individual segments are not secured in position relative to each other, creating instability of the device. Further, the '068 device is incapable of being folded into a size suitable for storage.

Miles, et al. ('552) disclose a creeper which is foldable for storage in a mechanic's tool chest. However, the '552 device is not foldable into a rolling utility cart or stool.

Finally, of the above-referenced patents, Parks ('744) discloses a utility cart having a rigid wheeled platform and a pivoting support bracket having a pivoting support. Because both the support and the support bracket are pivotable, the disposition of the support may be selected independently of the support bracket. However, the '744 device fails to teach a creeper which defines a torso support sufficient to support the back of a mechanic. Further, because of the pivoting nature of the support, the '744 device is incapable of being used as a utility cart for supporting heavy objects.

Another device typical of the art is that advertised in the Holiday Gift 1997 edition of SkyMall Magazine, page 202, item number 92164J, distributed by Griot's Garage. The Griot's creeper is described and illustrated as having an adjustable headrest. However, it is described as being foldable to either be used as a utility cart or for being stored. It does not appear from the illustration that either of these are features of the Griot's creeper.

Therefore, it is an object of this invention to provide a creeper capable of being folded to define a rolling utility cart.

Another object of the present invention is to provide such a creeper which may be further modified to define a rolling stool having a storage receptacle under a seat.

Still another object of the present invention is to provide such a creeper which, when folded to define a rolling utility cart or a rolling stool, the device is supported sufficiently to allow heavy loads to be placed thereon.

Yet another object of the present invention is to provide such a creeper which may be folded for storage within a drawer of a conventional tool chest.

Another object of the present invention is to provide such a creeper that, when configured to be used as a creeper, the headrest may be secured in a raised position for elevating a user's head.

DISCLOSURE OF THE INVENTION

Other objects and advantages will be accomplished by the present invention which is an improved creeper designed for being folded to define a rolling utility cart, a rolling stool having a storage receptacle under the seat, or to be folded for storage within a drawer of a conventional tool chest. When the creeper is folded to define a rolling utility cart or a rolling stool, the head rest is disposed to serve as a support surface or as a seat, and is supported sufficiently to allow heavy loads to be placed thereon. Further, the improved creeper is designed such that, when configured to be used as a creeper, the headrest may be secured in a raised position for elevating a user's head.

The improved creeper is comprised primarily of a frame segmented into a first support frame hingeably attached to a second support frame, which is hingeably attached to a third support frame. Each support frame is fabricated from two opposing side rails and at least two lateral members. The lateral members define a "U" shaped configuration such that the central portions thereof are at an optimal distance from a support surface in order to maximize head room while working under a vehicle and while allowing for clearance over items which may be on the support surface, such as wrenches, bolts, nuts, or the like. First, second and third cushions are mounted to the respective support frames to provide comfort to the user. A head rest cushion is attached to the cushion mounted on the third support frame via a tether in order to allow the disposition of the head rest cushion to be altered according to the relative orientation of the first, second and third support frames.

Casters are secured under the first and second support frames for accomplishing mobility of the creeper. Four casters are mounted under the first support frame, with one being disposed at each of the four corners thereof Another pair of casters is mounted under the second support frame, with one each being disposed proximate a corner farthest away from the first support frame.

A pair of oppositely disposed first braces is provided for maintaining a selected relative orientation of the third support frame and the first and second support frames, collectively. Each first brace is disposed on the outside of the frame and is comprised of first and second telescoping legs. A locking mechanism is provided for securing the second leg to the first leg at a selected location. Similarly, a pair of oppositely disposed second braces is provided for maintaining a selected orientation of the second support frame with respect to the first support frame. Each second brace is disposed on the inside of the frame and is comprised of first and second telescoping legs. The first telescoping leg is pivotally mounted at a first pivot on the first support frame and the second telescoping leg is pivotally mounted at a second pivot point on the second support frame. A locking mechanism is provided for securing the second leg to the first leg at a selected location.

The improved creeper may be manipulated to define several useful configurations. For example, the third support frame is pivoted upwardly to elevate the head of the user when the improved creeper is configured to define a creeper. In another configuration, the improved creeper is manipulated such that the second support frame is disposed at an acute angle with respect to the first support frame and the third support frame is disposed above and parallel to the first support frame. In this configuration, the head rest cushion is placed on what is now the top of the third support frame to serve as a seat cushion for a rolling stool, or may be left hanging from the tether such that the bottom surface of the third support frame defines a load bearing surface for a rolling utility cart. In the former, wherein the improved creeper defines a rolling stool, the first support frame is useful for carrying items related to the particular task.

In either of the latter configurations, the first and second braces are pivotally mounted on the frame so as to form an "X" configuration. The second and third support frames and the first braces substantially form a triangular configuration while the first and second support frames and the second braces likewise form a triangular configuration.

Finally, the improved creeper may be manipulated such that the second and third support frames are disposed in a face-to-face engagement with the first support frame, with the head rest cushion being positioned on the bottom side of the third support frame. In this disposition, the creeper has been folded to a size which may be conveniently stored in a storage drawer of a conventional tool chest.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An improved folding creeper incorporating various features of the present invention is illustrated generally at 10 in the figures. The improved folding creeper, or creeper 10, is designed for being folded to define a rolling utility cart, a rolling stool having a storage receptacle under the seat, or to be folded for storage within a drawer of a conventional tool chest. When the creeper 10 is folded to define a rolling utility cart or a rolling stool, the head rest is disposed to serve as a support surface or as a seat, and is supported sufficiently to allow heavy loads to be placed thereon. Moreover, the creeper 10 is designed such that, when configured to be used as a creeper, the headrest may be secured in a raised position for elevating a user's head.

Figure 1:
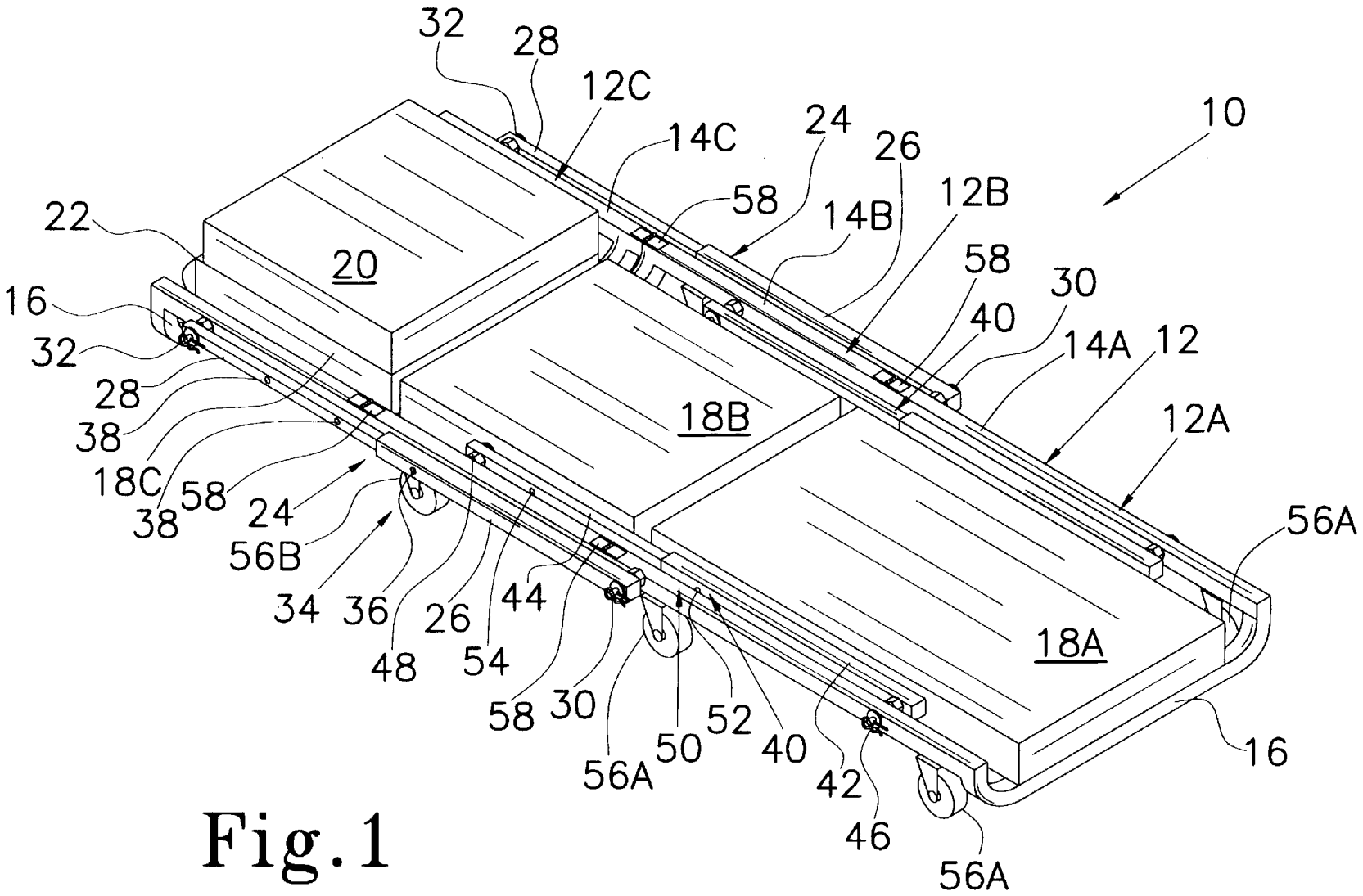
FIG. 1 is a perspective view of the improved folding creeper constructed in accordance with several features of the present invention, the improved folding creeper being disposed to be used as a creeper.
Figure 2:
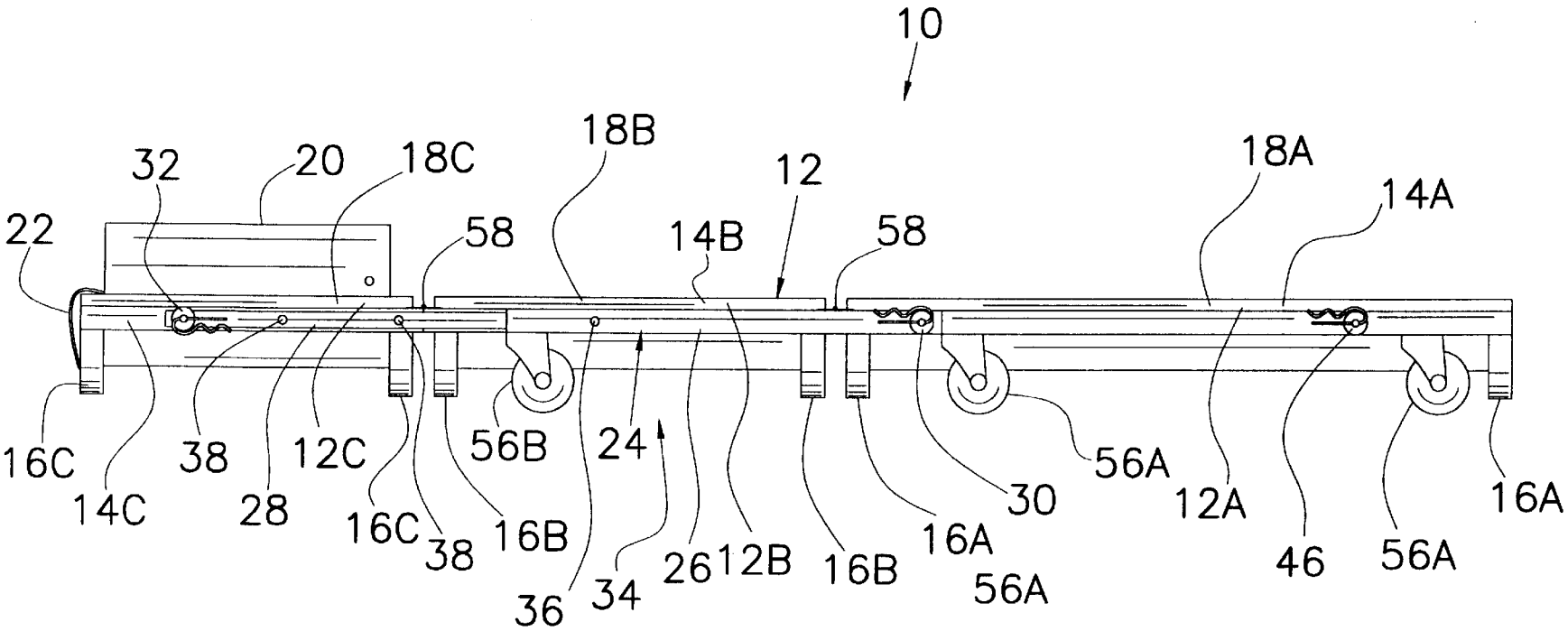
FIG. 2 is a side elevation view of the improved folding creeper of FIG. 1.
Figure 3:
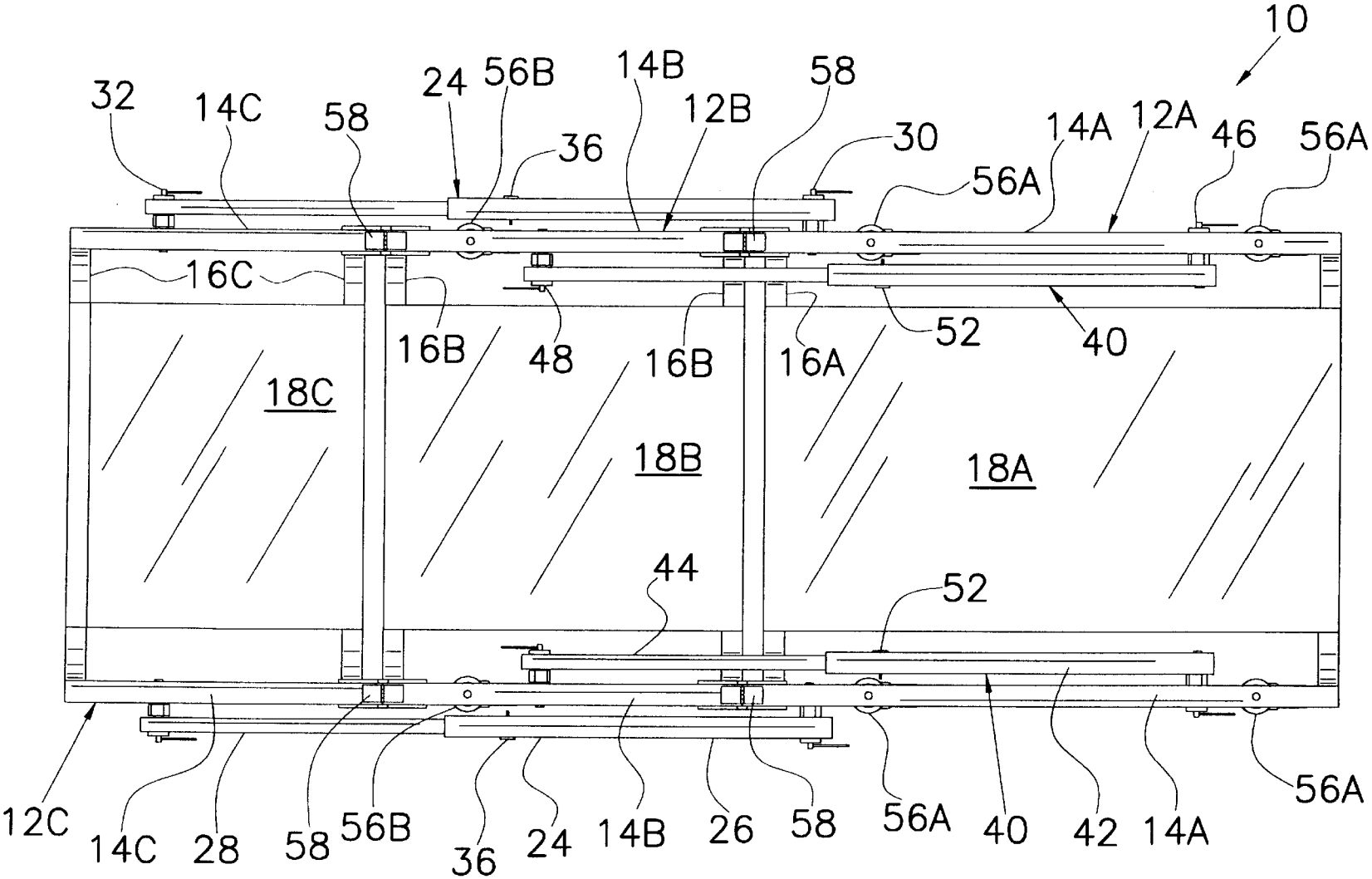
FIG. 3 is a top plan view of the improved folding creeper of FIG. 1.

As illustrated in FIGS. 1–3, the creeper 10 of the present invention is comprised primarily of a frame 12 segmented into three frame portions 12A,B,C. Specifically, the frame 12 includes a first support frame 12A, a second support frame 12B, and a third support frame 12C. Each support frame 12A,B,C is fabricated from two opposing side rails 14A,B,C, respectively, and at least two lateral members 16A,B,C. The lateral members 16 define a "U" shaped configuration such that the central portions thereof are at an optimal distance from a support surface, such as the floor, in order to maximize head room while working under a vehicle and while allowing for clearance over items which may be on the support surface, such as wrenches, bolts, nuts, or the like. The first and second support frames 12A,B are hingeably attached to one another in an end-to-end fashion via conventional hinges 58. Similarly, the second and third support frames 12B,C are hingeably attached to one another in an end-to-end fashion via conventional hinges 58. The hinges 58 are disposed to allow the top surfaces of the respective support frames 12A,B,C to move toward each other when the creeper 10 is folded to a selected configuration.

First, second and third cushions 18A,B,C are mounted to the respective lateral members 16A,B,C to provide comfort to the user of the creeper 10. A head rest cushion 20 is attached to the cushion 18C mounted on the third support frame 12C. In the preferred embodiment, the head rest cushion 20 is attached to the third cushion 18C via a tether 22 in order to allow the disposition of the head rest cushion 20 to be altered according to the relative orientation of the first, second and third support frames 12A,B,C.

Casters 56A,B are secured under the first and second support frames 12A,B for accomplishing mobility of the creeper 10. In the illustrated embodiment, four casters 56A are mounted under the first support frame 12A, with one being disposed at each of the four corners thereof A pair of casters 56B is mounted under the second support frame 12B, with one each being disposed proximate a corner farthest away from the first support frame 12A. To this extent, in the orientations of the creeper 10 as illustrated in FIGS. 1–4, the first and second support frames 12A,B cooperate to define a torso support, while the third support frame 12C serves as a head support. Thus, the casters 56A,B cooperate to support the corners and the central portion of the torso support. Further, because two casters 56A are disposed under the first support frame 12A proximate the hinges 58, when force is applied to the center portion of the torso support, as when a user is getting on or off of the creeper 10, the weight will be sufficiently supported so as not to collapse the creeper 10.

A pair of oppositely disposed first braces 24 is provided for maintaining a selected relative orientation of the third support frame 12C and the first and second support frames 12A,B, collectively. In the illustrated embodiment, each first brace 24 is disposed on the outside of the frame 12 and is comprised of first and second telescoping legs 26,28. The first telescoping leg 26 is pivotally mounted at a first pivot 30 on the first support frame 12A and the second telescoping leg 28 is pivotally mounted at a second pivot point 32 on the third support frame 12C. A locking mechanism 34 is provided for securing the second leg 28 to the first leg 26 at a selected location. In the illustrated embodiment, the locking mechanism 34 includes a spring loaded pin 36 carried by the first leg 26 for cooperating with one of a plurality of openings 38 defined by the second leg 28. The openings 38 on the second leg 28 are disposed at selected locations to accomplish selected orientations of the third support frame 12C with respect to the first and second support frames 12A,B.

A pair of oppositely disposed second braces 40 is provided for maintaining a selected orientation of the second support frame 12B with respect to the first support frame 12A. In the illustrated embodiment, each second brace 40 is disposed on the inside of the frame 12 and is comprised of first and second telescoping legs 42,44. The first telescoping leg 42 is pivotally mounted at a first pivot 46 on the first support frame 12A and the second telescoping leg 44 is pivotally mounted at a second pivot point 48 on the second support frame 12B. A locking mechanism 50 is provided for securing the second leg 44 to the first leg 42 at a selected location. In the illustrated embodiment, the locking mechanism 50 includes a spring loaded pin 52 carried by the first leg 42 for cooperating with one of at least one opening 54 defined by the second leg 44. The opening 54 on the second leg 44 is disposed at a selected location to accomplish at least one selected orientation of the second support frame 12B with respect to the first support frame 12A.

Figure 4:
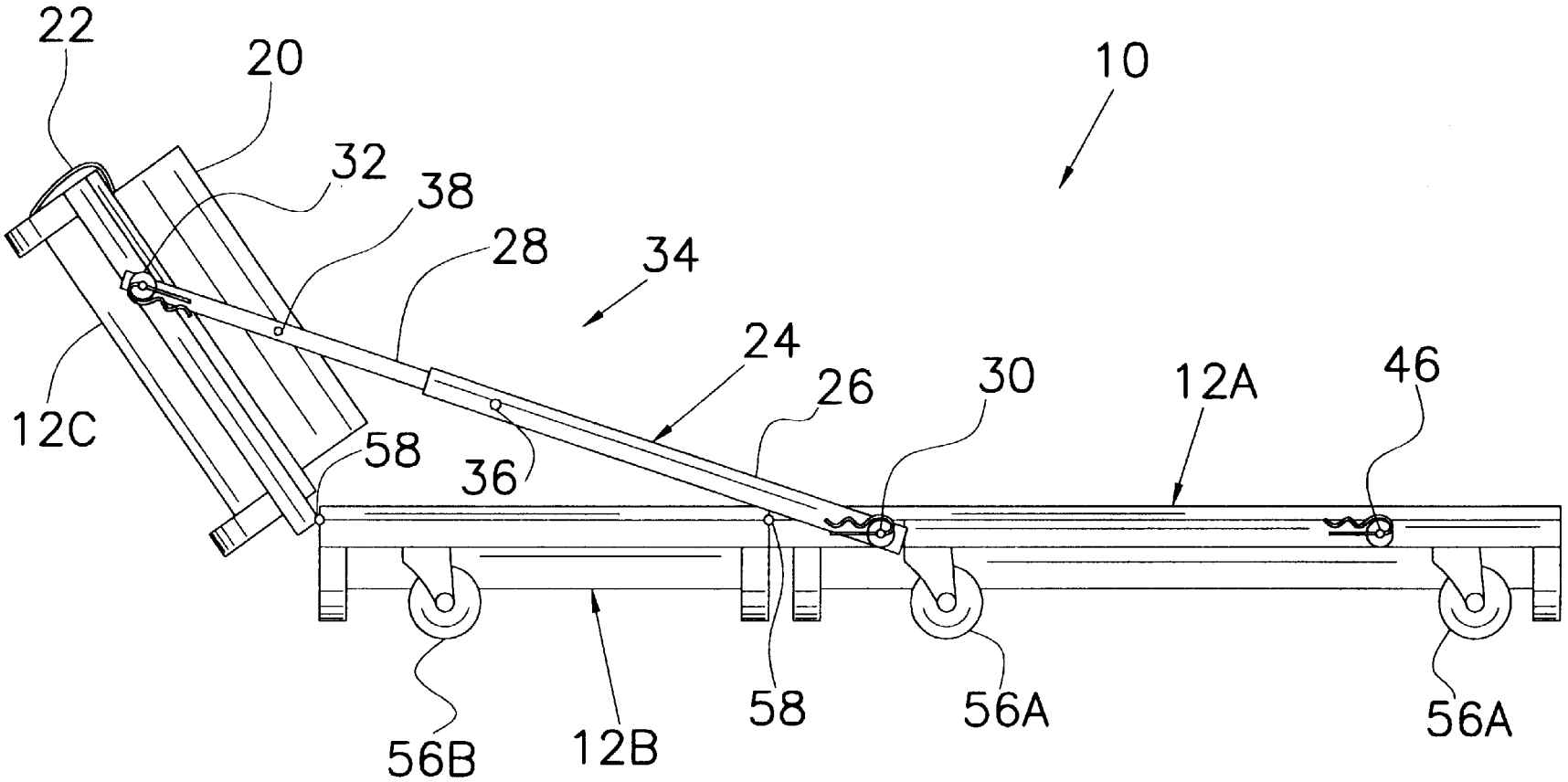
FIG. 4 is a side elevation view of the improved folding creeper of FIG. 1 wherein the headrest is supported in an elevated position.

FIG. 4 illustrates the creeper 10 wherein the third support frame 12C is pivoted upwardly, thereby elevating the head of the user. This orientation of the third support frame 12C is accomplished by engaging the spring loaded pin 36 of the first brace locking mechanism 34 with a corresponding opening 38 defined by the first brace second leg 28. Once engaged, the orientation of the third support frame 12C is maintained until disengaged.

Figure 5:
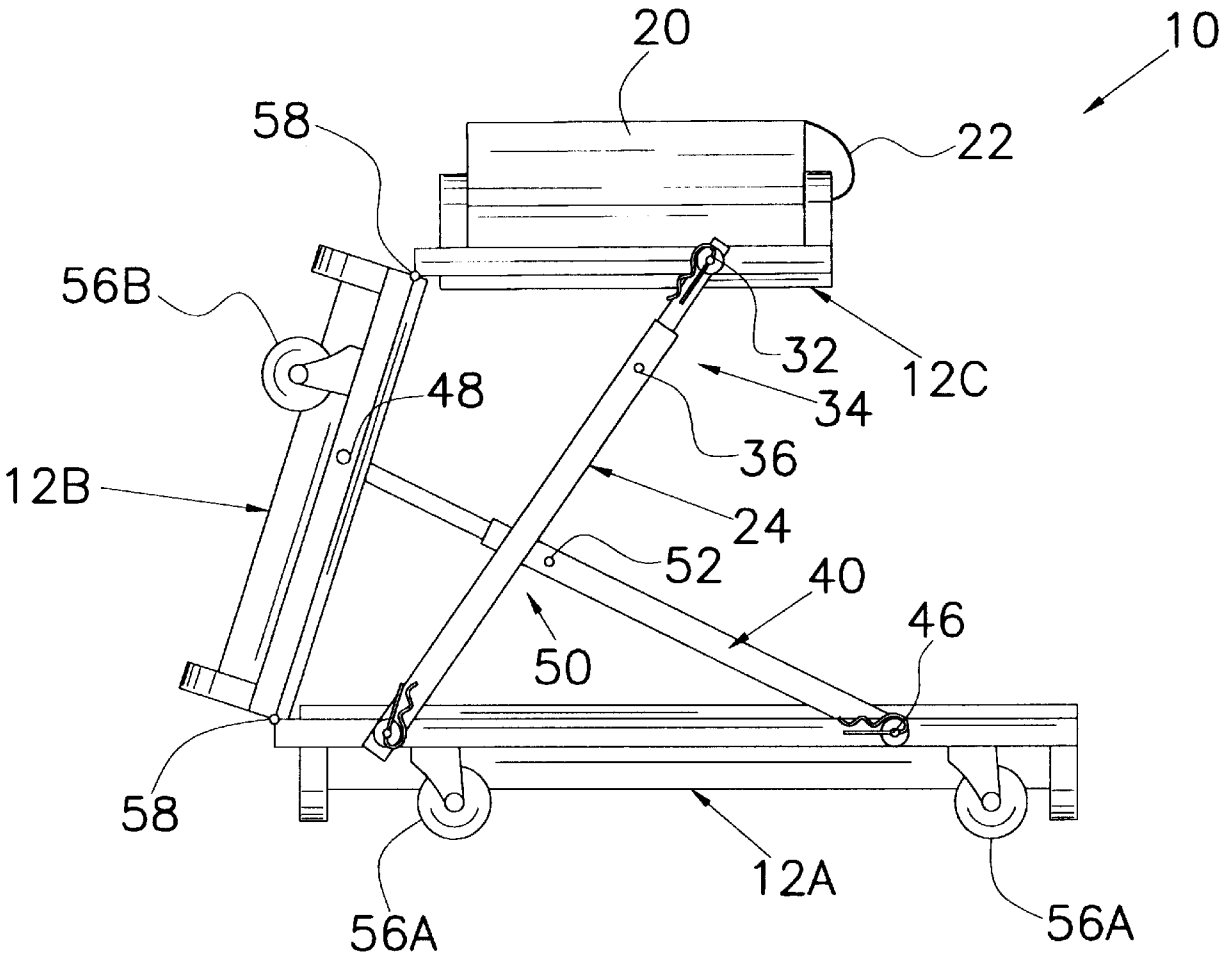
FIG. 5 is a side elevation view of the improved folding creeper of FIG. 1 wherein the improved folding creeper is folded to define a rolling stool, with the headrest cushion being disposed to be used as a seat cushion.

Illustrated in FIG. 5 is a further orientation of both the second and third support frames 12B,C. In this disposition of the creeper 10, the locking mechanism 50 of each second brace 40 is adjusted to dispose the second support frame 12B at an acute angle with respect to the first support frame 12A. The locking mechanism 34 of each first brace 24 is also adjusted to dispose the third support frame 12C above and parallel to the first support frame 12A. Thus, the third support frame 12C is horizontal relative to the support surface. Because the third support frame 12C is rotated one hundred and eighty degrees (180°) with respect to the position illustrated in FIGS. 1–3, i.e., the bottom of the third support frame 12C is disposed on the top, the head rest cushion 20 is placed on what is now the top, thus serving as a seat cushion for a stool. The first support frame 12A may be used in this orientation to support a mechanic's tools, for example, while the mechanic is seated on the stool. As the mechanic moves about on the stool, the tools are kept with him. Obviously, when the creeper 10 is formed into a stool and used in other applications, the first support frame 12A is useful for carrying items related to the particular task.

As illustrated, the first and second braces 24,40 are pivotally mounted on the frame 12 so as to form an "X" configuration when the creeper 10 is disposed to define a rolling stool. More specifically, the second and third support frames 12B,C and the first braces 24 substantially form a triangular configuration while the first and second support frames 12A,B and the second braces 40 likewise form a triangular configuration. Thus, the disposition of the first and second braces 24,40 accomplishes a structurally sound configuration, capable of sustaining relatively high loads.

Figure 5A:
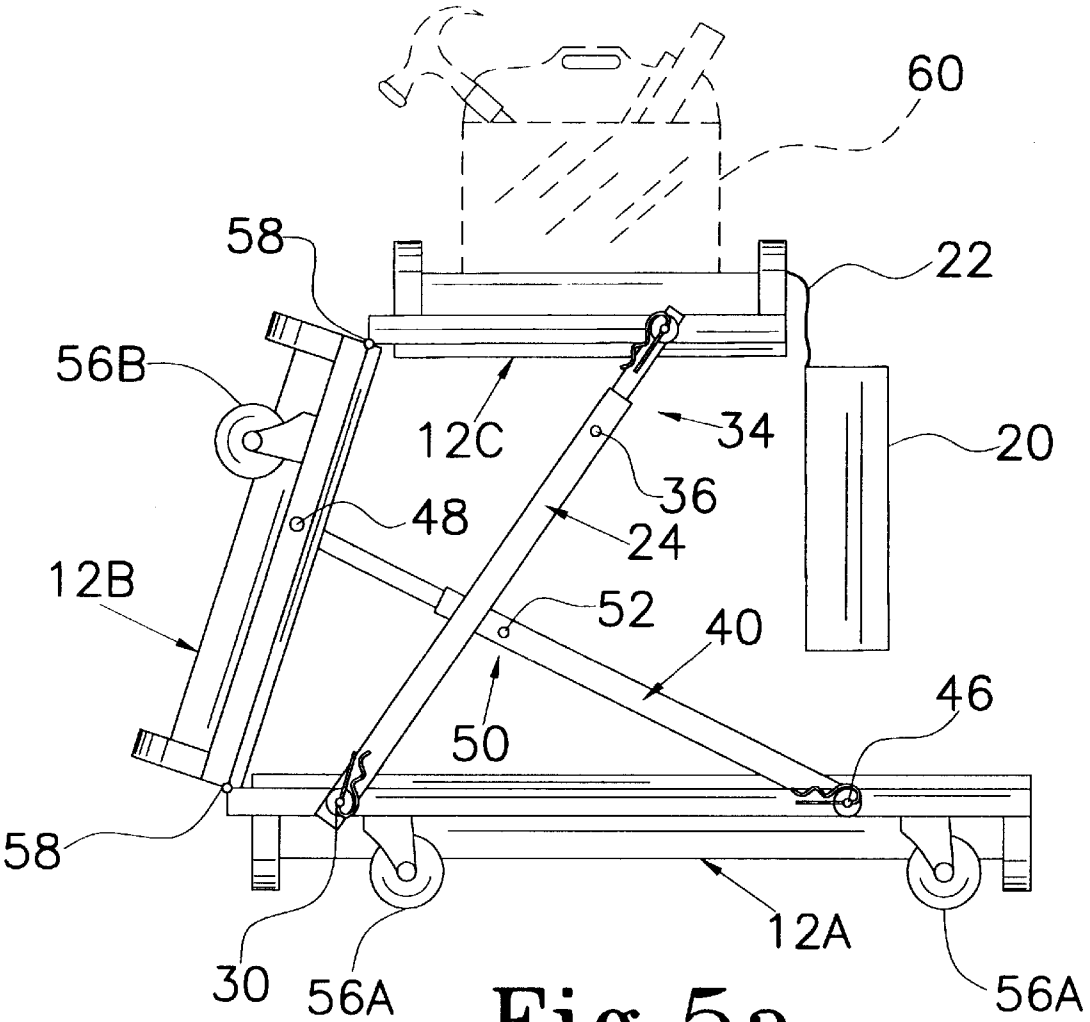
FIG. 5*a* is a side elevation view of the improved folding creeper of FIG. 1 wherein the improved folding creeper is folded to define a rolling utility cart, with the headrest cushion left hanging such that the bottom surface of the head rest defines a support surface for objects such as the tool box illustrated in phantom.

As illustrated in FIG. 5*a*, the disposition of the creeper 10 as illustrated in FIG. 5 may be adapted to a rolling utility cart simply by dropping the head rest cushion 20 to hang by the tether 22, thus exposing the bottom surface of the third support frame 12C. In so doing, the third support frame 12C becomes a support surface for objects such as the illustrated toolbox 60. Due to the construction of the creeper 10 as described above, the creeper 10 may also support automobile parts such as a transmission in order to facilitate transporting the same from one location to another.

Figure 6:
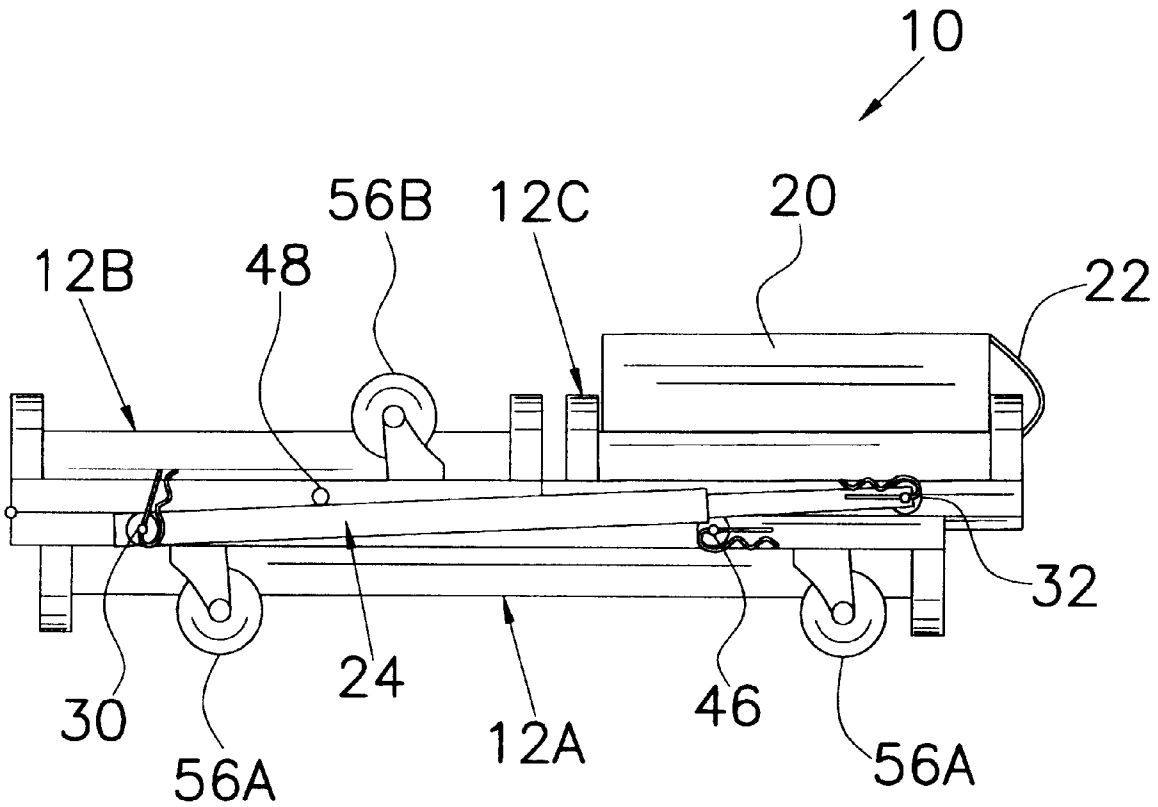
FIG. 6 is a side elevation view of the improved folding creeper of FIG. 1 wherein the improved folding creeper is folded for storage in a drawer of a conventional tool chest.

Finally, in the illustration of FIG. 6, the first and second brace locking mechanisms 34,50 may be adjusted to dispose the second and third support frames 12B,C in face-to-face engagement with the first support frame 12A, with the head rest cushion 20 being positioned on the bottom side of the third support frame 12C. In this disposition, the creeper 10 has been folded to a size which may be conveniently stored in a storage drawer of a conventional tool chest (not shown). By storing the creeper 10 in a drawer which may be locked, the creeper 10 is protected from theft, damage due to improper storage, or the like.

From the foregoing description, it will be recognized by those skilled in the art that a improved folding creeper offering advantages over the prior art has been provided. Specifically, the improved folding creeper is designed for being folded to define a rolling utility cart, a rolling stool having a storage receptacle under the seat, or to be folded for storage within a drawer of a conventional tool chest. When the creeper is folded to define a rolling utility cart or a rolling stool, the head rest is disposed to serve as a support surface or as a seat, and is supported sufficiently to allow heavy loads to be placed thereon. Moreover, the creeper of the present invention is designed such that, when configured to be used as a creeper, the headrest may be secured in a raised position for elevating a user's head.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A folding creeper for being manipulated to define a plurality of configurations for use in various applications, said folding creeper comprising:

a frame including a first support frame, a second support frame hingeably connected to said first support frame, and a third support frame hingeably connected to said second support frame, each of said first, second and third support frames defining a rectangular configuration;

a first cushion secured to said first support frame;

a second cushion secured to said second support frame;

a third cushion secured to said third support frame;

a first plurality of casters secured under said first support frame, said first plurality of casters being disposed proximate each corner of said first support frame;

a second plurality of casters secured under said second support frame, said second plurality of casters including at least a pair of said casters disposed at corners of said second support frame farthest away from said first support frame;

a pair of first braces for maintaining a selected orientation of said third support frame with respect to said first and second support frames, collectively, said pair of first braces being disposed on either side of any one said support frames, each of said pair first braces including a first leg, a second leg received within said first leg in a telescoping fashion, and a locking mechanism for locking a position of said second leg relative to said first leg, said first leg being pivotally mounted to said first support frame and said second leg being pivotally mounted to said third support frame; and a pair of second braces for maintaining a selected orientation of said second support frame with respect to said first support frame, said pair of second braces being disposed on either side of said frame.

2. The folding creeper of claim 1 wherein each of said first, second and third support frames is fabricated from two opposing side rails and at least two lateral members.

3. The folding creeper of claim 2 wherein said lateral members each define a "U" shaped configuration.

4. The folding creeper of claim 1 further comprising a head rest cushion attached to said third support frame via a tether, said head rest cushion being positionable according to a relative orientation of said first, second and third support frames.

5. The folding creeper of claim 1 wherein said first brace locking mechanism includes a pin carried by said first leg for cooperating with one of a plurality of openings defined by said second leg, each of said plurality of openings being disposed at a selected location to accomplish a selected orientation of said third support frame with respect to said first and second support frames.

6. The folding creeper of claim 1 wherein said each of said pair second braces includes a first leg, a second leg received within said first leg in a telescoping fashion, and a locking mechanism for locking a position of said second leg relative to said first leg, said first leg being pivotally mounted to said first support frame and said second leg being pivotally mounted to said second support frame.

7. The folding creeper of claim 6 wherein said second brace locking mechanism includes a pin carried by said first leg for cooperating with one of at least one opening defined by said second leg, each said opening being disposed at a selected location to accomplish a selected orientation of said second support frame with respect to said first support frame.

8. The folding creeper of claim 1 being configurable in at least a first disposition, a second disposition, a third disposition, and a fourth disposition, wherein:

said first disposition is defined by said first, second and third support frames being disposed in a planar fashion to define a creeper;

said second disposition is defined by said first and second support frames being disposed in a planar fashion to define a torso support of a creeper and wherein said third support frame is pivoted upwardly with respect to said first and second support frames to define an elevated head rest;

said third disposition is defined by said second support frame being disposed at an acute angle with respect to said first support frame and said third support frame being disposed above and parallel to said first support frame, said third disposition of said folding creeper rendering said folding creeper useful as either of a rolling stool and a rolling utility cart; and said fourth disposition is defined by said second and third support frames being disposed in face-to-face engagement with said first support frame, said fourth disposition of said folding creeper rendering said folding creeper folded to a size which may be conveniently stored.

9. The folding creeper of claim 8, in said third disposition of said folding creeper, wherein said pair of first braces and said pair of second braces are pivotally mounted on said frame so as to form an "X" configuration, said second and third support frames and said pair of first braces substantially forming a triangular configuration, and said first and second support frames and said pair of second braces forming a triangular configuration.

10. An folding creeper for being manipulated to define a plurality of configurations for use in various applications, said folding creeper comprising:

a frame including a first support frame, a second support frame hingeably connected to said first support frame, and a third support frame hingeably connected to said second support frame, each of said first, second and third support frames defining a rectangular configuration;

a first cushion secured to said first support frame;

a second cushion secured to said second support frame;

a third cushion secured to said third support frame;

a head rest cushion attached to said third support frame via a tether, said head rest cushion being positionable according to a relative orientation of said first, second and third support frames;

a first plurality of casters secured under said first support frame, said first plurality of casters being disposed proximate each corner of said first support frame;

a second plurality of casters secured under said second support frame, said second plurality of casters including at least a pair of said casters disposed at corners of said second support frame farthest away from said first support frame;

a pair of first braces for maintaining a selected orientation of said third support frame with respect to said first and second support frames, collectively, said pair of first braces being disposed on either side of any one of said support frames; and a pair of second braces for maintaining a selected orientation of said second support frame with respect to said first support frame, said pair of second braces being disposed on either side of any one of said support frames;

said folding creeper being configurable in at least a first disposition, a second disposition, a third disposition, and a fourth disposition, wherein:

said first disposition is defined by said first, second and third support frames being disposed in a planar fashion to define a creeper;

said second disposition is defined by said first and second support frames being disposed in a planar fashion to define a torso support of a creeper and wherein said third support frame is pivoted upwardly with respect to said first and second support frames to define an elevated head rest;

said third disposition is defined by said second support frame being disposed at an acute angle with respect to said first support frame and said third support frame being disposed above and parallel to said first support frame, said third disposition of said folding creeper rendering said folding creeper useful as either of a rolling stool and a rolling utility cart; and said fourth disposition is defined by said second and third support frames being disposed in face-to-face engagement with said first support frame, said fourth disposition of said folding creeper rendering said folding creeper folded to a size which may be conveniently stored.

11. The folding creeper of claim 10 wherein each of said first, second and third support frames is fabricated from two opposing side rails and at least two lateral members.

12. The folding creeper of claim 11 wherein said lateral members each define a "U" shaped configuration.

13. The folding creeper of claim 10 wherein said each of said pair first braces includes a first leg, a second leg received within said first leg in a telescoping fashion, and a locking mechanism for locking a position of said second leg relative to said first leg, said first leg being pivotally mounted to said first support frame and said second leg being pivotally mounted to said third support frame.

14. The folding creeper of claim 13 wherein said first brace locking mechanism includes a pin carried by said first leg for cooperating with one of a plurality of openings defined by said second leg, each of said plurality of openings being disposed at a selected location to accomplish a selected orientation of said third support frame with respect to said first and second support frames.

15. The folding creeper of claim 10 wherein said each of said pair second braces includes a first leg, a second leg received within said first leg in a telescoping fashion, and a locking mechanism for locking a position of said second leg relative to said first leg, said first leg being pivotally mounted to said first support frame and said second leg being pivotally mounted to said second support frame.

16. The folding creeper of claim 15 wherein said second brace locking mechanism includes a pin carried by said first leg for cooperating with one of at least one opening defined by said second leg, each said opening being disposed at a selected location to accomplish a selected orientation of said second support frame with respect to said first support frame.

17. The folding creeper of claim 10, in said third disposition of said folding creeper, wherein said pair of first braces and said pair of second braces are pivotally mounted on said frame so as to form an "X" configuration, said second and third support frames and said pair of first braces substantially forming a triangular configuration, and said first and second support frames and said pair of second braces forming a triangular configuration.

18. The folding creeper of claim 10, in said third disposition of said folding creeper, wherein said head rest cushion is disposed in either of a first disposition and a second disposition, said first disposition being defined by disposing said head rest cushion above said third support frame such that said creeper is configured to function as said rolling stool, said second disposition being defined by hanging said head rest cushion from said third support frame from said tether such that said creeper is configured to function as said rolling utility cart.

19. An folding creeper for being manipulated to define a plurality of configurations for use in various applications, said folding creeper comprising:

a frame including a first support frame, a second support frame hingeably connected to said first support frame, and a third support frame hingeably connected to said second support frame, each of said first, second and third support frames defining a rectangular configuration;

a first cushion secured to said first support frame;

a second cushion secured to said second support frame;

a third cushion secured to said third support frame;

a head rest cushion attached to said third support frame via a tether, said head rest cushion being positionable according to a relative orientation of said first, second and third support frames;

a first plurality of casters secured under said first support frame, said first plurality of casters being disposed proximate each corner of said first support frame;

a second plurality of casters secured under said second support frame, said second plurality of casters including at least a pair of said casters disposed at corners of said second support frame farthest away from said first support frame;

a pair of first braces for maintaining a selected orientation of said third support frame with respect to said first and second support frames, collectively, said pair of first braces being disposed on either side of said frame; and a pair of second braces for maintaining a selected orientation of said second support frame with respect to said first support frame, said pair of second braces being disposed on either side of said frame;

said folding creeper being configurable in at least a first disposition, a second disposition, a third disposition, and a fourth disposition, wherein:

said first disposition is defined by said first, second and third support frames being disposed in a planar fashion to define a creeper;

said second disposition is defined by said first and second support frames being disposed in a planar fashion to define a torso support of a creeper and wherein said third support frame is pivoted upwardly with respect to said first and second support frames to define an elevated head rest;

said third disposition is defined by said second support frame being disposed at an acute angle with respect to said first support frame and said third support frame being disposed above and parallel to said first support frame, said pair of first braces and said pair of second braces being pivotally mounted on said frame so as to form an "X" configuration, said second and third support frames and said pair of first braces substantially forming a triangular configuration, and said first and second support frames and said pair of second braces forming a triangular configuration, said head rest cushion being disposed in either of a first head rest cushion disposition and a second head rest cushion disposition, said first head rest cushion disposition being defined by disposing said head rest cushion above said third support frame such that said folding creeper is configured to function as a rolling stool, said second head rest cushion disposition being defined by hanging said head rest cushion from said third support frame from said tether such that said folding creeper is configured to function as a rolling utility cart; and said fourth disposition is defined by said second and third support frames being disposed in face-to-face engagement with said first support frame, said fourth disposition of said folding creeper rendering said folding creeper folded to a size which may be conveniently stored.

20. A folding creeper for being manipulated to define a plurality of configurations for use in various applications, said folding creeper comprising:

a frame including a first support frame, a second support frame hingeably connected to said first support frame, and a third support frame hingeably connected to said second support frame, each of said first, second and third support frames defining a rectangular configuration;

a first cushion secured to said first support frame;

a second cushion secured to said second support frame;

a third cushion secured to said third support frame;

a first plurality of casters secured under said first support frame, said first plurality of casters being disposed proximate each corner of said first support frame;

a second plurality of casters secured under said second support frame, said second plurality of casters including at least a pair of said casters disposed at corners of said second support frame farthest away from said first support frame;

a pair of first braces for maintaining a selected orientation of said third support frame with respect to said first and second support frames, collectively, said pair of first braces being disposed on either side of said frame; and a pair of second braces for maintaining a selected orientation of said second support frame with respect to said first support frame, said pair of second braces being disposed on either side of said frame, each of said pair second braces including a first leg, a second leg received within said first leg in a telescoping fashion, and a locking mechanism for locking a position of said second leg relative to said first leg, said first leg being pivotally mounted to said first support frame and said second leg being pivotally mounted to said second support frame.

21. The folding creeper of claim 20 wherein each of said first, second and third support frames is fabricated from two opposing side rails and at least two lateral members.

22. The folding creeper of claim 21 wherein said lateral members each define a "U" shaped configuration.

23. The folding creeper of claim 20 further comprising a head rest cushion attached to said third support frame via a tether, said head rest cushion being positionable according to a relative orientation of said first, second and third support frames.

24. The folding creeper of claim 20 wherein said second brace locking mechanism includes a pin carried by said first leg for cooperating with one of at least one opening defined by said second leg, each said opening being disposed at a selected location to accomplish a selected orientation of said second support frame with respect to said first support frame.

25. The folding creeper of claim 20 being configurable in at least a first disposition, a second disposition, a third disposition, and a fourth disposition, wherein:

said first disposition is defined by said first, second and third support frames being disposed in a planar fashion to define a creeper;

said second disposition is defined by said first and second support frames being disposed in a planar fashion to define a torso support of a creeper and wherein said third support frame is pivoted upwardly with respect to said first and second support frames to define an elevated head rest;

said third disposition is defined by said second support frame being disposed at an acute angle with respect to said first support frame and said third support frame being disposed above and parallel to said first support frame, said third disposition of said folding creeper rendering said folding creeper useful as either of a rolling stool and a rolling utility cart; and said fourth disposition is defined by said second and third support frames being disposed in face-to-face engagement with said first support frame, said fourth disposition of said folding creeper rendering said folding creeper folded to a size which may be conveniently stored.

26. The folding creeper of claim 25, in said third disposition of said folding creeper, wherein said pair of first braces and said pair of second braces are pivotally mounted on said frame so as to form an "X" configuration, said second and third support frames and said pair of first braces substantially forming a triangular configuration, and said first and second support frames and said pair of second braces forming a triangular configuration.

27. A folding creeper for being manipulated to define a plurality of configurations for use in various applications, said folding creeper comprising:

a frame including a first support frame, a second support frame hingeably connected to said first support frame, and a third support frame hingeably connected to said second support frame, each of said first, second and third support frames defining a rectangular configuration;

a first cushion secured to said first support frame;

a second cushion secured to said second support frame;

a third cushion secured to said third support frame;

a first plurality of casters secured under said first support frame, said first plurality of casters being disposed proximate each corner of said first support frame;

a second plurality of casters secured under said second support frame, said second plurality of casters including at least a pair of said casters disposed at corners of said second support frame farthest away from said first support frame;

a pair of first braces for maintaining a selected orientation of said third support frame with respect to said first and second support frames, collectively, said pair of first braces being disposed on either side of said frame; and a pair of second braces for maintaining a selected orientation of said second support frame with respect to said first support frame, said pair of second braces being disposed on either side of said frame;

said foldable creeper being configurable in at least a first disposition, a second disposition, a third disposition, and a fourth disposition, wherein:

said first disposition is defined by said first, second and third support frames being disposed in a planar fashion to define a creeper;

said second disposition is defined by said first and second support frames being disposed in a planar fashion to define a torso support of a creeper and wherein said third support frame is pivoted upwardly with respect to said first and second support frames to define an elevated head rest;

said third disposition is defined by said second support frame being disposed at an acute angle with respect to said first support frame and said third support frame being disposed above and parallel to said first support frame, said third disposition of said folding creeper rendering said folding creeper useful as either of a rolling stool and a rolling utility cart; and said fourth disposition is defined by said second and third support frames being disposed in face-to-face engagement with said first support frame, said fourth disposition of said folding creeper rendering said folding creeper folded to a size which may be conveniently stored.

28. The folding creeper of claim 27 wherein each of said first, second and third support frames is fabricated from two opposing side rails and at least two lateral members.

29. The folding creeper of claim 28 wherein said lateral members each define a "U" shaped configuration.

30. The folding creeper of claim 27 wherein said each of said pair first braces includes a first leg, a second leg received within said first leg in a telescoping fashion, and a locking mechanism for locking a position of said second leg relative to said first leg, said first leg being pivotally mounted to said first support frame and said second leg being pivotally mounted to said third support frame.

31. The folding creeper of claim 30 wherein said first brace locking mechanism includes a pin carried by said first leg for cooperating with one of a plurality of openings defined by said second leg, each of said plurality of openings being disposed at a selected location to accomplish a selected orientation of said third support frame with respect to said first and second support frames.

32. The folding creeper of claim 27 wherein said each of said pair second braces includes a first leg, a second leg received within said first leg in a telescoping fashion, and a locking mechanism for locking a position of said second leg relative to said first leg, said first leg being pivotally mounted to said first support frame and said second leg being pivotally mounted to said second support frame.

33. The folding creeper of claim 32 wherein said second brace locking mechanism includes a pin carried by said first leg for cooperating with one of at least one opening defined by said second leg, each said opening being disposed at a selected location to accomplish a selected orientation of said second support frame with respect to said first support frame.

34. The folding creeper of claim 27, in said third disposition of said folding creeper, wherein said pair of first braces and said pair of second braces are pivotally mounted on said frame so as to form an "X" configuration, said second and third support frames and said pair of first braces substantially forming a triangular configuration, and said first and second support frames and said pair of second braces forming a triangular configuration.

* * * * *

UNITED STATES PATENT AND TRADEMARK OFFICE

CERTIFICATE OF CORRECTION

PATENT NO. : 6,095,532

DATED : August 1, 2000

INVENTOR(S) : James E. Martin

It is certified that error appears in the above-indentified patent and that said Letters Patent is hereby corrected as shown below:

Title Page, item [73] delete "Morristown, N.J." and insert – Morristown, TN --.

Signed and Sealed this

Tenth Day of April, 2001

*Attest:*

Nicholas P. Godici

NICHOLAS P. GODICI

*Attesting Officer*

*Acting Director of the United States Patent and Trademark Office*